US006382616B1

(12) United States Patent
Waragai et al.

(10) Patent No.: US 6,382,616 B1
(45) Date of Patent: May 7, 2002

(54) ALIGNING DEVICE FOR SHEET FINISHER

(75) Inventors: Tsuyoshi Waragai; Teruo Komatsu; Yasuyoshi Hayakawa, all of Mishima; Tomoyuki Araki, Numazu; Atsushi Ogata; Masayoshi Fukatsu, both of Shizuoka-ken, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/487,306

(22) Filed: Jan. 19, 2000

(30) Foreign Application Priority Data

Jan. 19, 1999 (JP) ..... 11-010873
Jan. 19, 1999 (JP) ..... 11-010874
Dec. 28, 1999 (JP) ..... 11-375785

(51) Int. Cl.[7] ..... B65H 31/36

(52) U.S. Cl. ..... 270/58.12; 270/58.08; 271/221; 271/222

(58) Field of Search ..... 270/58.07, 58.08, 270/58.1, 58.11, 58.12; 271/220, 221, 222, 240, 242, 226, 236

(56) References Cited

U.S. PATENT DOCUMENTS 4,988,085 A * 1/1991 Maekawa et al. ..... 270/58.11
5,020,784 A * 6/1991 Asami et al. ..... 270/58.11
5,115,281 A 5/1992 Ohtsuka et al. ..... 355/319
5,154,411 A 10/1992 Saito et al. ..... 271/289
5,155,537 A 10/1992 Komatsu et al. ..... 355/309
5,288,062 A * 2/1994 Rizzolo et al. ..... 271/220 X
5,292,116 A 3/1994 Inoue et al. ..... 271/157
5,348,284 A 9/1994 Ishihama et al. ..... 271/160
5,465,141 A 11/1995 Asano et al. ..... 355/285
5,501,444 A 3/1996 Yukimachi et al. ..... 271/127
5,592,280 A * 1/1997 Ishizuka et al. ..... 270/58.08 X
5,649,276 A * 7/1997 Quesnel et al. ..... 271/242 X
5,695,186 A * 12/1997 Phillips et al. ..... 271/252
5,738,346 A * 4/1998 Ishida ..... 270/58.07
5,765,824 A * 6/1998 Kawano et al. ..... 270/58.11
5,826,158 A * 10/1998 Hirano et al. ..... 270/58.08 X
5,937,260 A * 8/1999 Taninaka et al. ..... 271/240 X

* cited by examiner

*Primary Examiner*—Christopher P. Ellis
*Assistant Examiner*—Patrick Mackey
(74) *Attorney, Agent, or Firm*—Fitzpatrick, Cella, Harper & Scinto

(57) ABSTRACT

A sheet treating apparatus has a discharging device for discharging a sheet with an image formed thereon to a sheet stacking device, the stacking device having an abutment reference member disposed on the leading end side of the sheet stacking device and an urging member disposed on a sheet trailing end side of the sheet stacking device for urging the sheet discharged from the discharging device toward the abutment reference member.

19 Claims, 9 Drawing Sheets

ALIGNING DEVICE FOR SHEET FINISHER

BACKGROUND OF THE INVENTION

1. Field of the Invention

The present invention relates to a sheet treating apparatus, particularly to a sheet treating apparatus, for example, for aligning and stitching a sheet bundle, and an image forming apparatus provided with this sheet treating apparatus.

2. Related Background Art

For a conventional sheet stitching apparatus (sheet treating apparatus) for stitching the end of a sheet bundle formed by aligning a plurality of sheets, the following apparatus is general.

A sheet on which an image is formed by a main body of an image forming apparatus is discharged from a predetermined discharge port of the image forming apparatus main body in a predetermined timing. The sheet is accepted from an inlet port of a sheet stitching apparatus, nipped by a sheet conveying roller, and conveyed to a sheet stitching portion. Thereafter, a plurality of sheets are stacked on a sheet stacking portion for stacking the sheets to be stitched. The stacked sheets are aligned in a sheet conveying direction and in a sheet width direction orthogonal to the conveying direction before subjected to sheet stitching. After a sheet bundle is aligned, sheet stitching means performs a designated stitching operation of the sheet bundle. Additionally, the sheet stitching comprises performing the stitching in a position where the sheet bundle is aligned, or conveying the aligned sheet bundle in toto to a sheet stitching position and performing the sheet stitching in the position.

An aligning operation usually comprises thrusting a leading end of the sheet onto an abutment portion disposed on the leading end side of the sheet conveying direction with a belt or a roller, a paddle or another rotating member, a pressing member constituted to be reciprocatable in the sheet conveying direction for abutting against a trailing end of the sheet to press the leading end of the sheet onto the abutment portion, and the like so that the sheet conveying direction is aligned. Furthermore, the alignment of the sheet width direction orthogonal to the sheet conveying direction is performed by alignment plates which can reciprocate in the sheet width direction and operate so as to hold the sheets stacked on the sheet stacking portion from both sides.

The stitched sheet bundle is discharged onto a sheet discharge tray of the sheet treating apparatus disposed in a position where a user can take the sheet bundle by discharging means such as a sheet bundle conveying roller pair, a belt member and a conveying member for abutting against the sheet bundle to push out the sheet bundle.

By repeating the above-described operation for the necessary number of sheet bundles, the sheet bundles are successively discharged, and stacked onto the sheet discharge tray.

In the above-described conventional example, however, the following improvements are demanded.

In the sheet treating apparatus for performing a predetermined treatment on the sheet, a pretreatment sheet which is provided with the formed image and conveyed to the sheet treating apparatus needs to be accurately aligned. For this, the sheet stacking portion is positioned for temporarily stacking the conveyed sheet before the predetermined treating operation is performed, and the aligning operation is performed in the position.

However, in some cases, a sufficient alignment cannot be performed because of the sheet conveying state, sheet type, and other factors.

For example, in case that ends (leading end and trailing end) of the sheet in the conveying direction of the sheet are curled, when the sheet is to be aligned in the sheet conveying direction, the end fails to correctly abut against the abutment portion, and the aligning property in the sheet conveying direction is deteriorated.

Moreover, when the sheet is discharged to the sheet stacking portion, the sheet largely deviates in a direction different from the discharge direction due to a discharging energy, and in some cases the sheet deviates from a position on the sheet stacking portion where an appropriate aligning operation can be performed.

In order to solve these problems, it is considered that an uncurling member for removing the sheet curl during sheet conveying, or a large-sized aligning device be disposed, but such member enlarges the sheet treating apparatus, and further increases manufacture costs, which disagrees with user's demands for small size, space saving and cost reduction on the image forming apparatus and the sheet treating apparatus.

SUMMARY OF THE INVENTION

The present invention has been developed to solve the above-described problems, and an object thereof is to provide a sheet treating apparatus which prevents the sheet conveyed to sheet stacking means from deviating and which can securely perform sheet aligning, stitching, and another sheet treating even in a curled sheet, and an image forming apparatus provided with the sheet treating apparatus. The sheet treating apparatus comprises discharging means for conveying and discharging a sheet with an image formed thereon; sheet stacking means on which the sheet discharged by the discharging means is stacked; an abutment reference member disposed on the side of a sheet leading end of a direction in which the sheet is discharged onto the sheet stacking means from the discharging means, against which abutment reference member a leading end of the sheet discharged onto the sheet stacking means abuts; and an urging member disposed on the side of a sheet trailing end of the direction in which the sheet is discharged onto the sheet stacking means from the discharging means, for urging the sheet discharged from the discharging means toward the abutment reference member.

DETAILED DESCRIPTION OF THE PREFERRED EMBODIMENTS

A sheet treating apparatus and an image forming apparatus provided with the sheet treating apparatus according to the present invention will be described hereinafter in detail with reference to the drawings.

Figure 1:
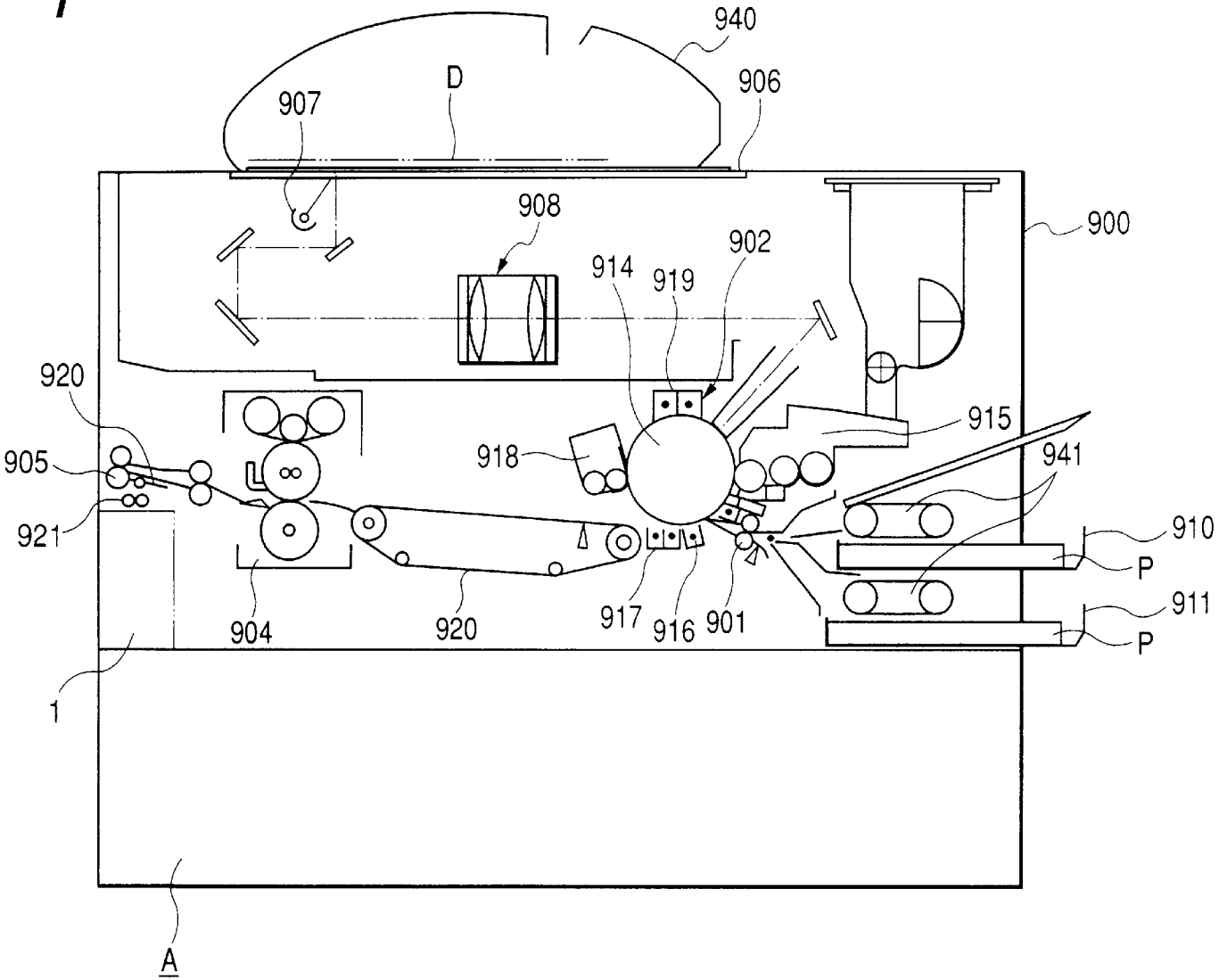
FIG. 1 is a vertical sectional front view showing one example of a main body of an image forming apparatus provided with a sheet treating apparatus according to the present invention.

FIG. 1 shows one example of the image forming apparatus provided with the sheet treating apparatus of the present invention. Additionally, the image forming apparatus is not limited to a copying machine or a printer utilizing an electrophotographic process, a copying machine or a printer employing an ink jet image recording system, and other image forming means, as long as the means forms an image on a sheet. In the present embodiment, the copying machine using the electrophotographic process will be illustrated.

A main body (copying machine main body) 900 of the image forming apparatus is provided with image reading means comprising an image reader having a platen glass plate 906 as an original stocking plate on which an original is rested to read an image, a light source 907 for irradiating the original, a lens system 908 for condensing light reflected by the original, and the like, an automatic original feeder 940 for realizing automatic original feeding, and the like; sheet conveying means comprising sheet cassettes 910, 911 as sheet storage means detachably mounted to the main body of the apparatus, for storing the sheet on which the image is to be formed, a sheet feeding member 941 for separating and feeding one by one sheets stored in the sheet cassettes, a registration roller 901 for feeding the fed sheet to an image forming portion 902 in synchronism with an image forming timing, and the like; the image forming portion 902 comprising a photosensitive drum 914 for forming an electrostatic latent image, developing means 915 for developing the electrostatic latent image on the drum 914, transfer means 916 for transferring a toner image formed on the photosensitive drum 914 onto the sheet, separating means 917 for separating the transferred sheet, and the like; a conveying belt 920 for conveying the sheet with the image transferred thereto; a fixing device 904 as fixing means for fixing the image on the sheet; and the like.

A sheet treating apparatus A which practices the present invention is disposed under the copying machine 900 as the above-described image forming apparatus. The sheet treating apparatus A will be described later in detail.

An image forming operation in this copying machine will be described.

When an image forming start signal is inputted to a controller (not shown) of the copying machine 900 from a user or an external terminal, a sheet S is fed by the sheet feeding member 941 from the sheet cassettes 910, 911. On the other hand, the light source 907 moves and irradiates an original D rested on the platen glass plate 906 with light. The light reflected by the original D is irradiated onto the photosensitive drum 914 via the lens system 908. The surface of the photosensitive drum 914 is uniformly charged by a primary charger 919 beforehand, and the electrostatic latent image is formed by irradiating the light. Subsequently, the electrostatic latent image is developed by the developing device 915 and a toner image is formed on the photosensitive drum 914.

For the sheet S fed by the sheet feeding member 941, a skew feed is corrected by the registration roller 901, and the sheet is fed to the image forming portion 902 with a timing adapted to the timing of the image forming operation. In the image forming portion 902, the toner image of the photosensitive drum 914 is transferred to the fed sheet S with the transfer charger 916, the sheet S with the toner image transferred thereto is charged by the separation charger 917 to provide a polarity opposite to that of the transfer charger 916, and the sheet is separated from the photosensitive drum 914.

Subsequently, the separated sheet S is conveyed to the fixing device 904 by the conveying belt 920, and provided with heat and pressure by the fixing device 904 so that the image is fixed on the sheet S. The sheet S with the image fixed thereto is discharged to the outside of the apparatus by a discharge roller pair 905, or conveyed to an inlet portion 1 of the sheet treating apparatus A from the apparatus main body 900 by main body discharging rollers (main body discharging means) 921.

Figure 2:
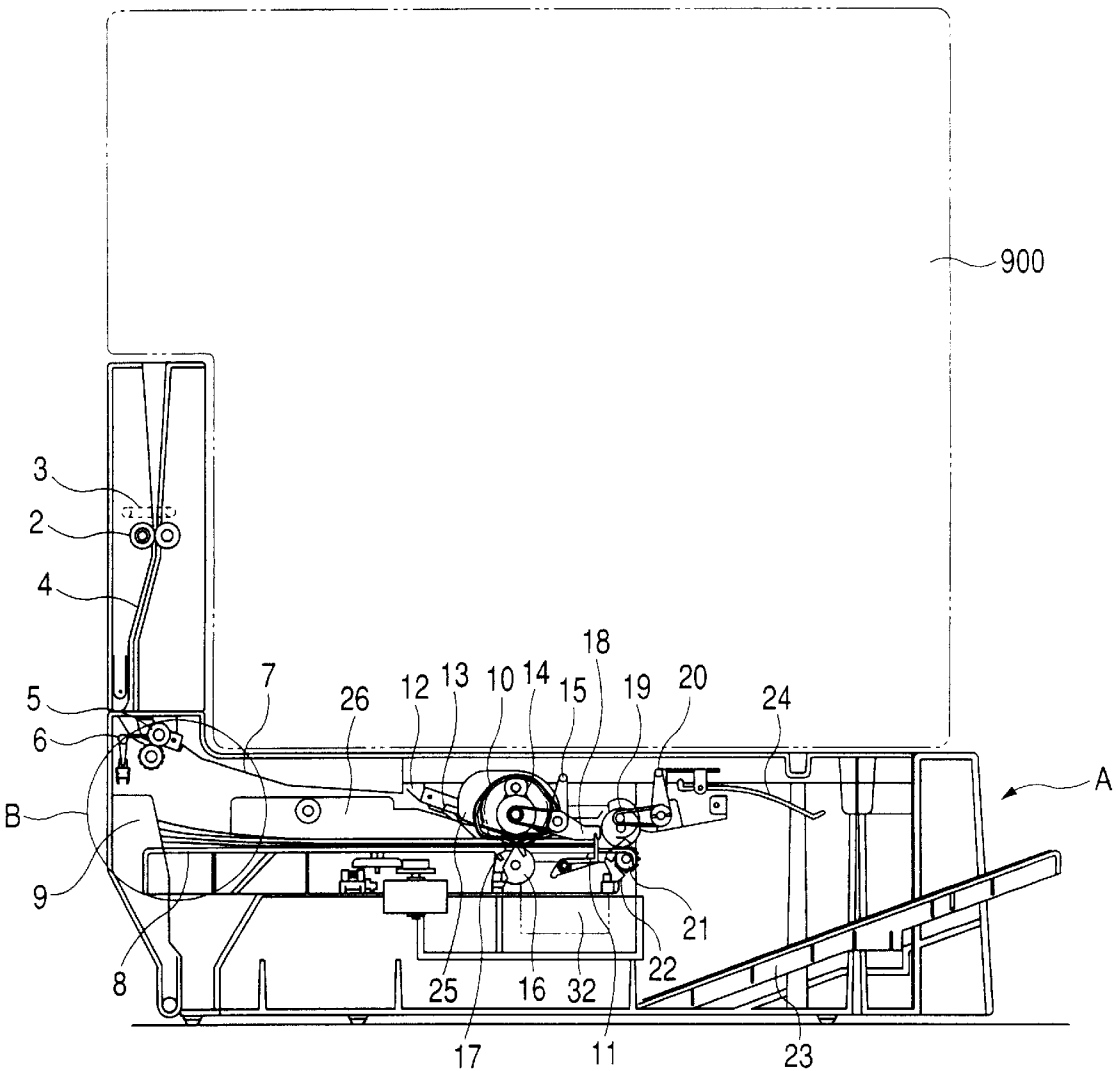
FIG. 2 is a vertical sectional front view of the sheet treating apparatus according to an embodiment of the present invention.

The sheet treating apparatus of the present invention will next be described. FIG. 2 shows a vertical sectional side view of the sheet treating apparatus A.

As shown in FIG. 2, the sheet treating apparatus A which practices the present invention is disposed under the copying machine main body 900 shown by a virtual line. Numeral 2 denotes an inlet conveying roller pair disposed in a sheet inlet portion, 3 denotes an inlet sensor for detecting that a sheet P enters the sheet stitching apparatus A as the sheet treating apparatus, 4 denotes a guide plate for guiding the conveyed sheet P to the sheet treating portion, 5 denotes a discharging roller pair as discharging means for conveying and stacking the sheet P to the sheet treating portion, and 6 denotes a sheet position detecting lever disposed in the vicinity of the discharging roller pair 5.

Numeral 7 denotes an upper sheet guide plate when the sheet is discharged by the discharging roller pair 5, and the leading end of the sheet P is guided to an aligning tray 8 described later by this upper sheet guide plate 7. The aligning tray 8 is substantially horizontally disposed as sheet stacking means for temporarily stacking the sheet P discharged by the discharging roller pair 5 to align the sheet.

A sheet trailing end urging rib 9 is an urging member for urging the trailing end of the sheet discharged onto the aligning tray 8 toward the conveying direction, and is provided with an inclined face 9*a* (FIG. 6), so that the sheet P is pushed out (urged) toward the discharge direction. Additionally, a plurality of sheet trailing end urging ribs 9 are spaced apart from each other in the sheet width direction perpendicular to the sheet conveying direction on the aligning tray 8. Since the plurality of the sheet trailing end urging ribs 9 are spaced apart from each other, the friction resistance with the abutting sheet trailing end can be reduced. The sheet trailing end urging rib 9 will be described later in detail.

A conveying belt 10 is conveying means for further conveying the sheet P discharged onto the aligning tray 8 by the discharging roller pair 5 toward the downstream side of the conveying direction, and is constituted to increase an abutment area of the sheet and the belt 10 as the number of stacked sheets increases. This conveying belt 10 rotates while abutting against the sheet so that the leading end of the sheet discharged onto the aligning tray 8 is abutted against a sheet leading end stopper 11 as an abutment reference member, but even after the sheet leading end abuts against the sheet leading end stopper 11, the conveying belt contacts the topmost sheet and rotates in the conveying direction to urge the sheet. However, in order to prevent the sheet P from going beyond the stopper 11, buckling between the sheet leading end stopper 11 and the conveying belt 10, or jamming otherwise after the sheet P abuts against the sheet leading end stopper 11, the conveying belt 10 is provided with only a sheet conveying force to such an extent that slippage is generated between the topmost sheet and the conveying belt 10 after the sheet P abuts against the sheet leading end stopper 11.

Numeral 12 denotes a conveying guide for receiving the sheet P from the guide 7 and guiding the sheet to the conveying belt 10, and 13 denotes a residual charge eliminating brush attached to the conveying guide for eliminating the residual charge of the sheet P. The distal ends of the brush always contact the topmost sheet on the aligning tray 8. Moreover, the brush is disposed at an angle counter to a sheet returning direction in order to prevent the sheet P from returning in a direction opposite to the sheet conveying direction by the contact energy of sheet P with the residual charge eliminating brush 13.

Figure 8:
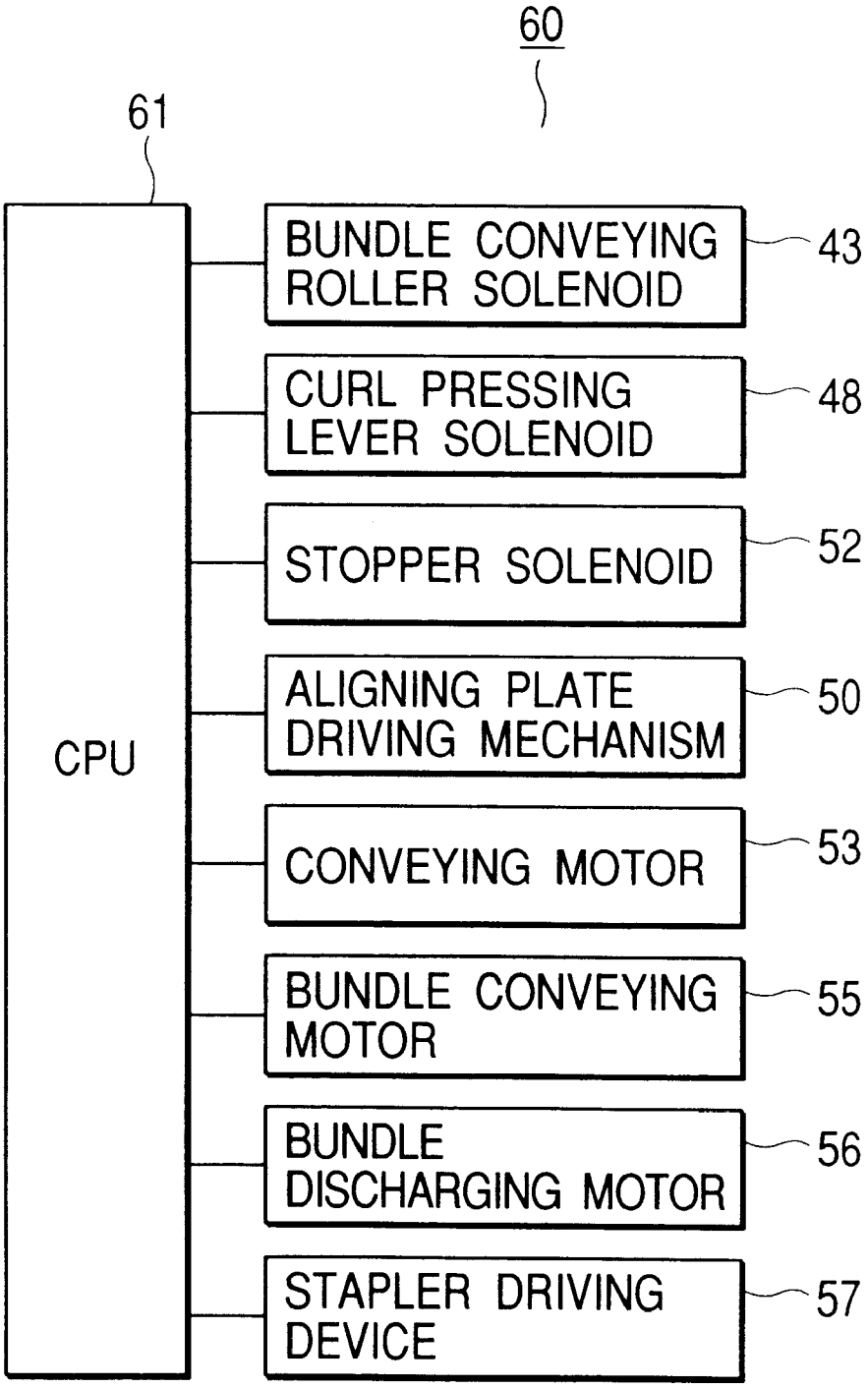
FIG. 8 is a block diagram showing a control of the present invention.

An upper sheet bundle conveying roller 14 is disposed in a position substantially coinciding with the axial direction of the conveying belt 10 and deviating from the conveying belt 10. The upper sheet bundle conveying roller 14 is held by an arm 15*a* extended in a horizontal direction in a two-arm lever 15, and can vertically move by turning on/off a bundle conveying roller solenoid 43 (FIG. 8). A lower sheet bundle conveying roller 16 is disposed opposite to the upper sheet bundle conveying roller 14 via the sheet P. The lower sheet bundle conveying roller 16 rotates by a drive force transmitted by a bundle conveying motor 55 (FIG. 8).

Numeral 17 denotes a stack detecting lever for detecting that the sheets are stacked on the aligning tray 8, and a plurality of curl pressing levers 18, as an abutment reference member for pressing the curl on the sheet leading end, are arranged in the sheet width direction. Numeral 19 denotes an upper bundle discharging roller for discharging the sheet bundle from the aligning tray 8. A lower bundle discharging roller 21 is disposed opposite to the upper sheet discharging roller 19. Additionally, the upper bundle discharging roller 19 is constituted so that the upper bundle discharging roller 19 is movable to contact with and separate from the lower bundle discharging roller 21 by the rotation of a lever 20 which supports the upper bundle discharging roller 19.

A discharge sensor 22 is disposed in the vicinity of a pair of bundle discharging rollers 19, 21, numeral 23 denotes a discharged sheet stacking tray for stacking the sheets discharged from the aligning tray 8, and 24 denotes a full load detecting lever for detecting the stacked state of the sheets P discharged onto the discharged sheet stacking tray 23.

Numeral 25 denotes a conveying belt holder for regulating both sides of the conveying belt 10 with a predetermined distance, an aligning plate 26 is a plate member of width aligning means for moving and aligning the sheet in the sheet width direction which is perpendicular to the sheet conveying direction, a substantially conical rotatable pressing roller 27 (FIG. 5) is disposed on the surface of the aligning plate 26 which abuts against the sheet, an apparatus side plate 28 is a plate member of the width aligning means disposed opposite to the aligning plate 26, a conical rotatable pressing roller 29 is disposed on a plane opposite to the side plate 28, and sheet abutment reference surfaces 30, 31 are disposed on the side plate 28. Numeral 32 denotes a stapler shown by a virtual line as sheet stitching means for stitching the sheets. The sheet stitching means 32 is disposed so that the predetermined position of the sheet bundle can be stitched in a direction parallel to the sheet conveying direction.

Figure 3:
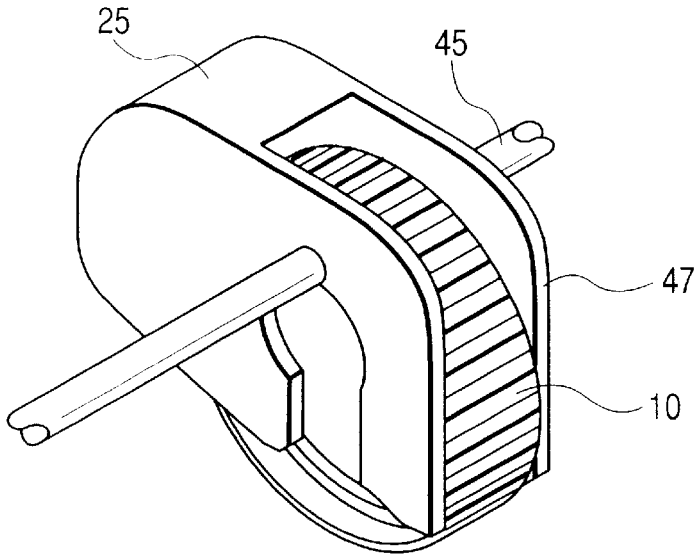
FIG. 3 is a perspective view of a conveying belt holder.

In FIG. 3, a frame 47 of the conveying belt holder 25 is supported on a support shaft 45, and the support shaft 45 is provided with a roller 46 (FIG. 4) which abuts against the conveying belt 10 to rotate the conveying belt 10.

Additionally, the frame 47 is disposed to regulate the conveying belt 10 in order to prevent the sheet P from deviating by a restoring force by which the displaced conveying belt 10 tries to return to its original position, while the conveying belt 10 is displaced in the sheet width direction by the action of the sheet P moved by the aligning operation in the sheet width direction described later when the aligning plate 26 completes the aligning operation and is detached from the sheet.

The sheet treating operation by the above-described constitution will next be described with reference to FIGS. 1 to 8. First, the flow from when the sheet P with the image formed thereon is conveyed toward the sheet stitching apparatus A to when the sheet is stacked on the aligning tray 8 will be described.

The sheet P discharged from the image forming apparatus main body 900, with its leading end nipped by the inlet conveying rollers 2, is conveyed toward the sheet stitching apparatus A. In this case, the inlet sensor 3 detects that the sheet P is conveyed toward the sheet stitching apparatus A, and the detected information is transmitted to CPU 61. The sheet P is guided by the guide plate 4, and conveyed and discharged toward the aligning tray 8 by the discharging roller pair 5. It can be detected by the sheet position detecting lever 6 whether or not the sheet P is completely discharged by the discharging roller pair 5.

When the sheet P is conveyed onto the aligning tray 8 by the discharging roller pair 5, the sheet leading end is inserted to the nip portion formed by the conveying belt 10 and the top surface of the aligning tray 8, subjected to the conveying force applied by the conveying belt 10 and the discharging roller pair 5, and conveyed toward the downstream side, so that the sheet trailing end is discharged from the discharging roller pair 5.

Subsequently, when the sheet leading end abuts against the sheet leading end stopper 11, the conveying force of the conveying belt 10 is small, and the yield strength of the sheet having abutted against the sheet leading end stopper 11 overcomes the conveying force, so that the conveying belt 10 is slipped on the surface of the sheet P. Therefore, the sheet P is on standby on the aligning tray 8 while always receiving a small conveying force in the conveying direction.

Figure 5:
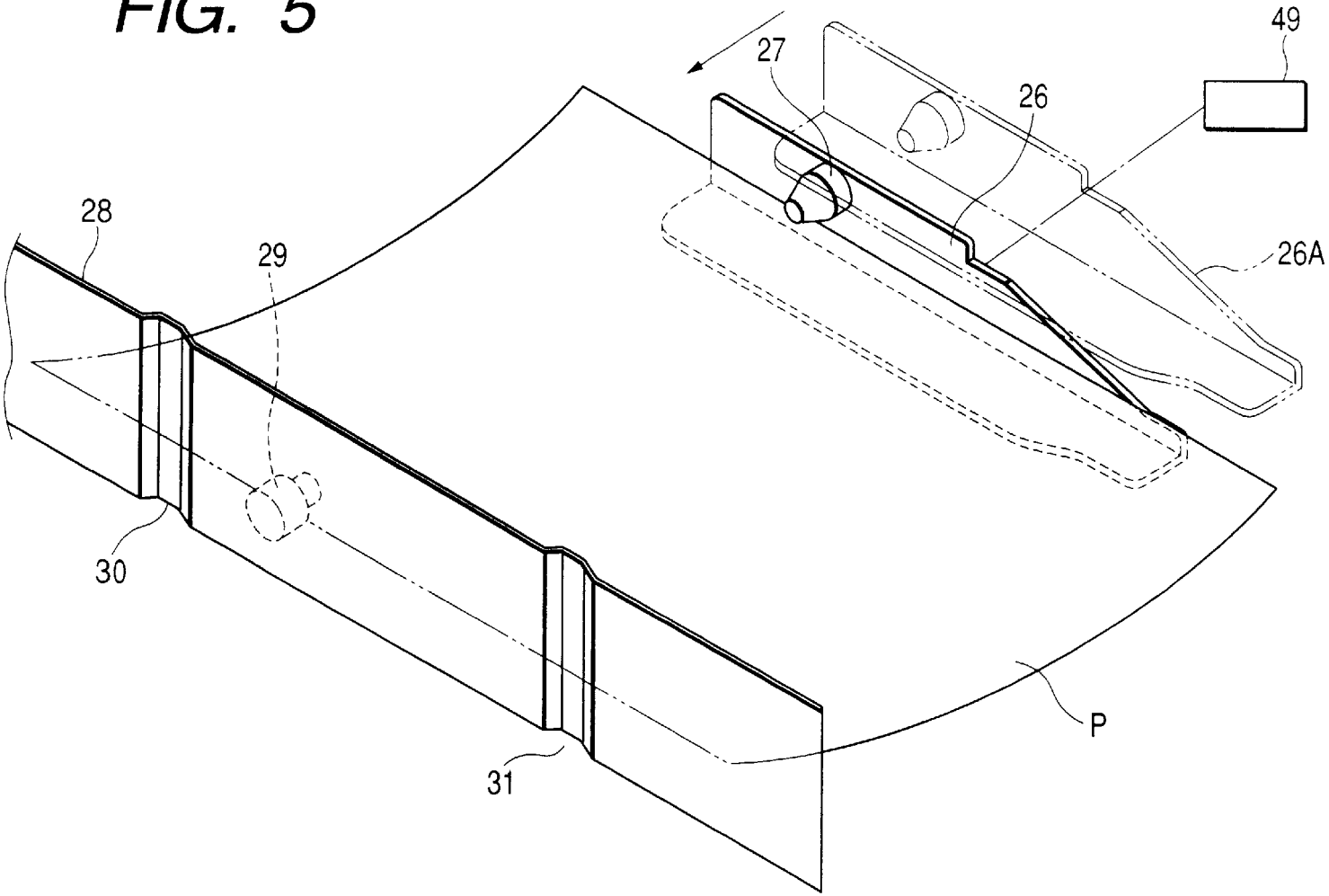
FIG. 5 is a perspective view showing an aligning portion for a sheet width direction.

The aligning of the sheet P stacked on the aligning tray 8 in the width direction will next be described with reference to FIG. 5.

As described above, after the sheet P having abutted against the sheet leading end stopper 11 is placed on standby on the aligning tray 8, the aligning plate 26 moves from a standby position 26A shown by an alternate long and two short dashes line toward the side plate 28 of the apparatus. By the movement, the sheet P stacked on the aligning tray 8 abuts against the aligning plate 26, and is completely pushed to a position where the sheet securely abuts against the abutment reference surfaces 30, 31 disposed on the side plate 28. The above-described operation of the aligning plate 26 is performed by rotations of a drive motor 49 (FIG. 5) included in an aligning plate driving mechanism 50 shown in FIG. 8.

Additionally, the sheet P may be curled in the sheet width direction which is perpendicular to the sheet conveying direction in some cases. As shown in FIG. 5, when the curled sheet P is pressed onto the abutment reference surfaces 30, 31 by the operation of the aligning plate 26, the side end of the sheet P slides in the curled direction (upward) along the abutment reference surfaces 30, 31 by the action of the curl. In this situation, since the sheet aligning property is deteriorated, in the present invention, the aligning plate 26 and the side plate 28 are provided with the rollers 27, 29 which can rotate and whose free ends have conical shapes. Even when the curled sheet P is aligned, the rollers 27, 29 can prevent the sheet side end from sliding beyond a predetermined height at which the rollers are disposed, so that the aligning property of the sheet width direction can be enhanced.

Moreover, for the rollers 27, 29, the free ends not supported by the aligning plate 26 and the side plate 28 have conical shapes. Therefore, even when the sheet P is curled, the sheet side end can easily be guided to the predetermined height. Furthermore, since the rollers 27, 29 are rotatably constituted, they do not form any resistance in the conveying direction of the sheet P.

With respect to the alignment of the sheet P, the operation of the aligning plate 26 will further be described.

Since there is a dispersion in the width of the sheet P, and the curled state of the sheet P differs with sheets, the distance formed by the aligning plate 26 and the abutment reference surfaces 30, 31 during the alignment is designed to be shorter than the width of the conveyed sheet. Moreover, since the aligning plate 26 is moved to the position narrower than the sheet width even during the alignment of thick sheets with strong rigidity or the alignment of a large amount of sheets, a large load is applied to the drive motor 49 of the aligning plate 26. This load possibly shortens the life of the drive motor 49, or the load during the aligning operation possibly causes the motor to step out.

Therefore, an elastic member (not shown) is disposed between the aligning plate 26 and the driving mechanism 50, so that when a predetermined load or more load is applied to the aligning plate 26, the aligning plate 26 escapes in the direction opposite to the aligning direction (toward the standby position).

The above-described aligning operation is performed every time the predetermined number of sheets P to be stitched are discharged and stacked on the aligning tray 8, so that the sheets are successively aligned.

Figure 4:
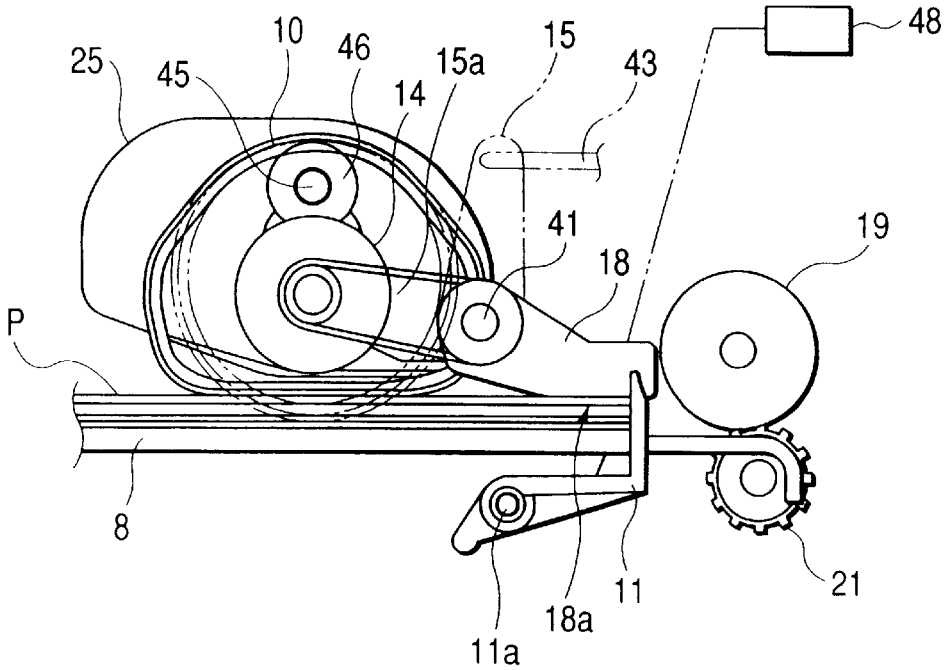
FIG. 4 is a side view showing an aligning portion for a sheet leading end.

The aligning operation of the sheet conveying direction will next be described with reference to FIG. 4.

As described above, the sheets P are discharged onto the aligning tray 8, and conveyed by the conveying belt 10 to abut against the sheet leading end stopper 11, but some of the sheets P with the image formed thereon are curled in the sheet conveying direction. Even the sheet having a curl on its leading end has a possibility that the aligning property is deteriorated in the same manner as the sheet having a curl in the sheet width direction.

Therefore, in the present embodiment, the sheet leading end is pressed from above by the curl pressing lever 18 in order that even the sheet P having the curl on its leading end can adequately be aligned.

The curl pressing lever 18 with its end supported by a support shaft 41 is movable between a position for pressing the sheet and a position separated from the sheet by turning on/off a curl pressing lever solenoid 48. A plurality of curl pressing levers 18 are arranged in the width direction of the sheet P. By pressing the curl on the leading end of the sheet, the sheet leading end substantially perpendicularly abuts against the sheet leading end stopper 11, so that the leading ends can securely be aligned.

During the sheet stacking operation and aligning operation, since the solenoid 48 is turned off, the curl pressing lever 18 abuts against the aligning tray 8 by its own weight. The curl pressing lever 18 is tapered on the side of the conveying belt 10 in order that the sheet P discharged on the aligning tray 8 can easily enter between the curl pressing lever 18 and the aligning tray 8, and the leading end of the sheet P conveyed by the conveying belt 10 can slides into the lower part of the curl pressing lever 18.

The operation of the sheet trailing end urging rib 9 will next be described with reference to FIG. 6, in which when the sheet with the image formed thereon is discharged onto the aligning tray 8 from the discharging roller pair 5 and stacked, the sheet trailing end is urged by the rib 9.

Figure 6:
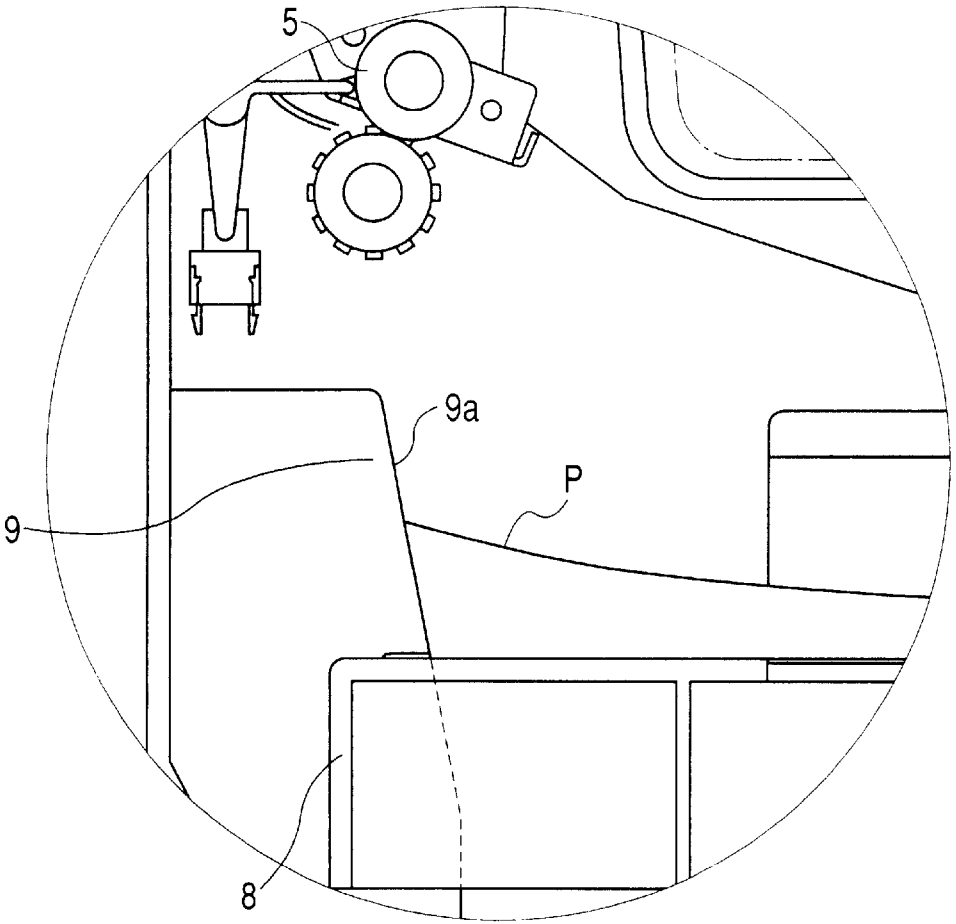
FIG. 6 is a side view of an urging member for urging a sheet trailing end, and shows the encircled portion indicated by the sign B in FIG. 2.

FIG. 6 shows that the sheet P is discharged from the discharging roller pair 5, drops onto the aligning tray, and is conveyed toward the sheet leading end stopper 11 by the conveying belt. The sheet P is discharged onto the aligning tray 8 by the discharging roller pair 5, but at the moment the trailing end of the sheet P goes out of the nip portion of the discharging roller pair 5, by the influence of the rigidity, deflection, and the like of the sheet, a force acts such that the sheet P tries to return in the direction opposite to the sheet conveying direction. Furthermore, in some cases the sheet deviates rearward by the impact generated when the sheet drops onto the aligning tray 8.

The sheet leading end is nipped by the conveying belt 10 and the aligning tray 8, and the conveying force is applied toward the sheet leading end stopper 11 by the conveying belt 10, but the conveying force of the conveying belt 10 is slight as described above. Therefore, in some cases, the sheet P yields to the force by which the sheet trailing end tries to deviate rearward or return, and returns in the direction opposite to the sheet conveying direction. In this situation, the sheet leading end nipped by the conveying belt 10 and the aligning tray 8 deviates in the direction opposite to the conveying direction, a sufficient conveying force cannot be obtained from the conveying belt 10, and the sheet cannot be conveyed. Moreover, in a further worse case, the nipped sheet leading end drops out in the direction opposite to the conveying direction from the nip portion of the conveying belt 10 and the aligning tray 8.

In this situation, the aligning property of the sheet conveying direction is deteriorated. Such phenomenon more remarkably appears on a thick sheet, a large-size sheet, a sheet with a large friction coefficients between sheets, and a large number of sheets stacked on the aligning tray 8.

Therefore, the sheet trailing end urging rib 9 is disposed in order to prevent the sheet P from returning in the direction opposite to the conveying direction by holding the trailing end of the sheet P discharged from the discharging roller pair 5, and to urge the sheet P in the conveying direction. As shown in FIG. 6, the sheet abutment surface which is the urging surface of the sheet trailing end urging rib 9 forms the inclined surface 9*a*, and the trailing end of the sheet P discharged from the discharging roller pair 5 contacts the inclined surface 9*a*. As shown in FIG. 6, when the sheet trailing end is lifted up, the sheet can be prevented from going backward by the impact of the drop, and the like.

Figure 10:
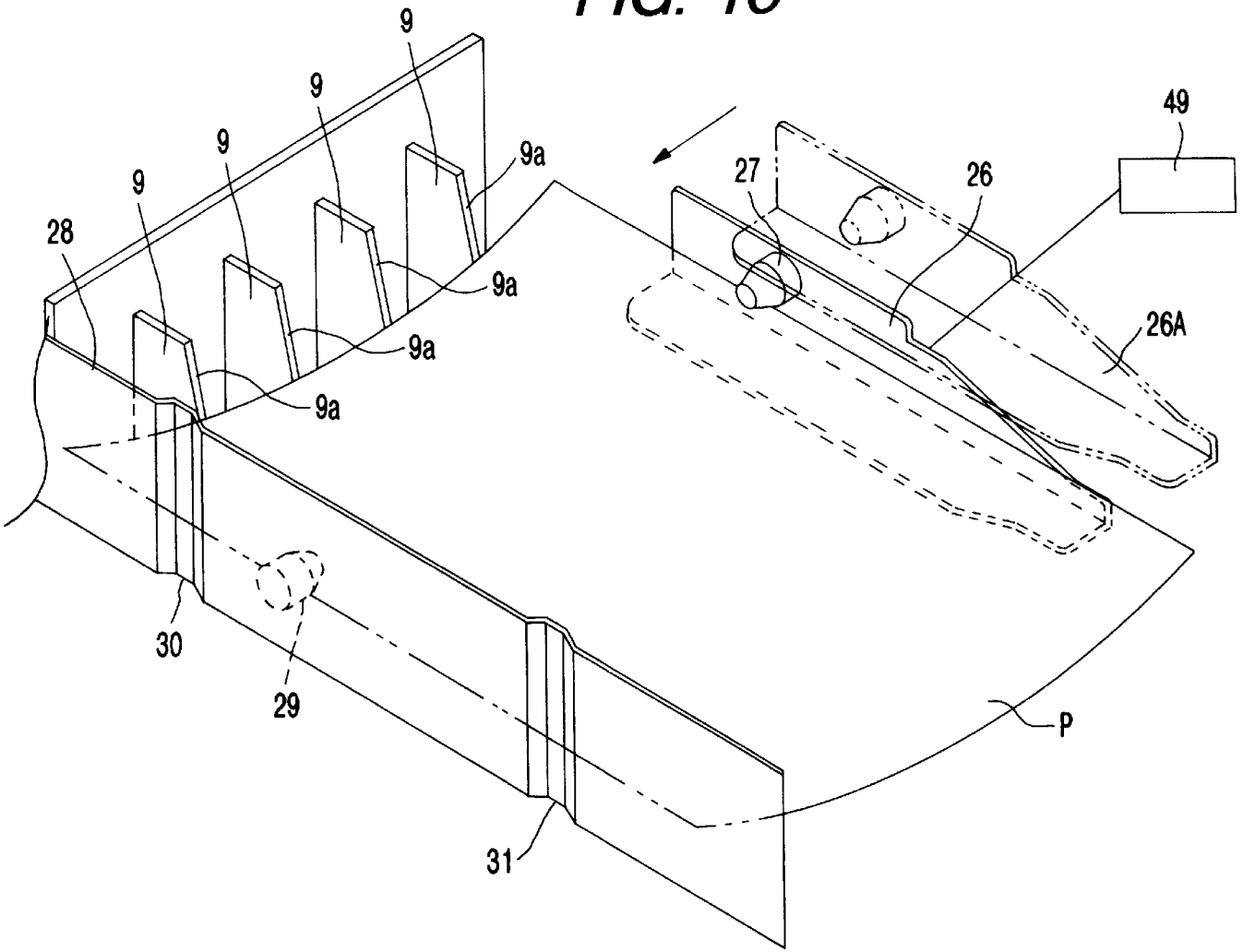
FIG. 10 is a perspective view showing an alternate portion of an aligning portion for a sheet width direction.

FIG. 10 illustrates a perspective view of an alternate embodiment wherein the urging member consists of a plurality of sheet trailing end urging ribs spaced apart from each other in a sheet width direction which is perpendicular to the direction in which the sheet is discharged. The sheet abut next surface which are the urging surfaces of the sheet trailing end urging ribs 9 form the inclined surfaces 9*a* and the trailing end of the sheet contacts the inclined surface 9*a*.

Furthermore, the inclined surface 9*a* as the urging surface has an action of allowing the sheet trailing end to slide down onto the aligning tray 8 along the inclined surface 9*a*. Since the inclined surface 9*a* has an inclination lowering toward the sheet leading end stopper 11, the sheet P abuts against the inclined surface 9*a* and then slides in the sheet conveying direction. Therefore, even when the conveying belt 10 has a slight conveying force, the energy of the sliding sheet forms the conveying force, and the sheet P can smoothly be conveyed, so that the leading end can abut against the sheet leading end stopper 11. This can enhance the aligning property of the sheet conveying direction, obviates the necessity of disposing a special aligning device like the aligning plate, and can therefore contribute to the reduction of the apparatus size and manufacture cost.

As described above, by repeating the above operation, the predetermined number of sheets to be stitched are stacked on the aligning tray 8, but the aligning operation of the final sheet out of the predetermined number of sheets is changed to the aligning operation of the other sheets.

For the sheets other than the final sheet of the predetermined number of sheets, the above-described aligning operation of the sheet width direction is performed twice. Specifically, when the sheet P is aligned in the sheet width direction, the aligning plate 26 is moved from the standby position to the predetermined aligning position, the aligning plate 26 is then returned in its open direction once, and then the aligning plate 26 is moved to the predetermined aligning position again. By performing the aligning operation of the aligning plate 26 twice, the aligning property of the sheet P can further be enhanced.

On the other hand, after the final sheet is discharged onto the aligning tray 8, the aligning operation by the above-described aligning plate 26 is performed four times. Thereby, the alignment of the sheet bundle in the width direction is finally secured before the sheet bundle on the aligning tray 8 is stapled by the stapler 32, so that the apparatus reliability can be enhanced.

Additionally, in the present embodiment, the usual aligning operation frequency (P) is set to twice, and the aligning operation frequency (Q) after the final sheet is discharged is set to four times, but the present invention is not limited to these numeric values as long as a relation of (P)<(Q) is satisfied.

The aligning operation of the sheet P with the image formed thereon has been described above.

The stitching operation of the sheet bundle stacked on the aligning tray 8 by the above-described series of aligning operations will next be described.

Figure 7:
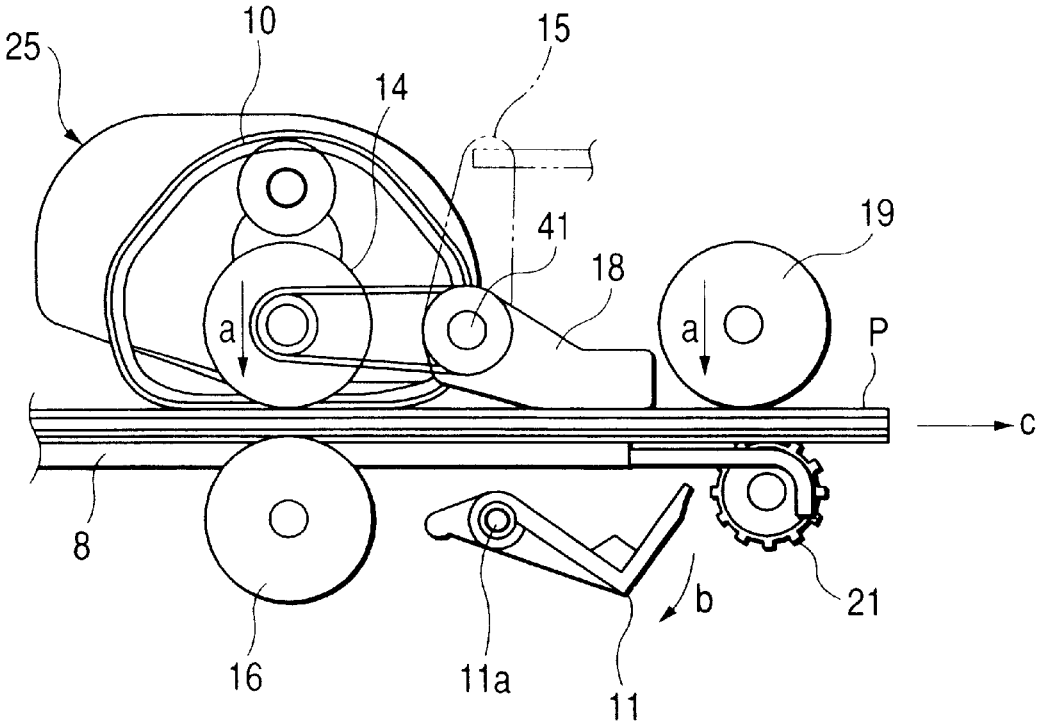
FIG. 7 is a side view of the leading end aligning portion showing the discharge state of a sheet bundle.

When the predetermined number of sheets to be stitched are discharged onto the aligning tray 8, and the above-described aligning operation is completed, the upper bundle conveying roller 14 shown in FIG. 7 moves toward the aligning tray 8 (in a direction indicated by the arrow a in FIG. 7) by the operation of the bundle conveying roller solenoid 43 (FIG. 8), and nips a sheet bundle P together with the lower bundle conveying roller 16.

Subsequently, the sheet leading end stopper 11 rotates in a direction indicated by the arrow b about a rotation center shaft 11*a* of the stopper 11 by the operation of a stopper solenoid 52 (FIG. 8), and releases the sheet leading end having abutted. Moreover, when the curl pressing lever solenoid 48 is turned on, the curl pressing lever 18 having abutted against the topmost sheet P by its own weight is moved to the position spaced apart from the sheet P. Thereafter, the upper and lower bundle conveying rollers 14, 16 are driven by the bundle conveying motor 55 (FIG. 8) to start rotating in a predetermined timing, and the sheet bundle P is conveyed toward the stapler 32 (in a direction indicated by the arrow c in FIG. 7).

The rotating speed of the bundle conveying motor 55 (FIG. 8) is set so that a conveying speed V2 on conveying the sheet bundle P becomes slower than a conveying speed V1 on conveying the sheet P onto the aligning tray 8. This is performed in order to prevent the alignment from deviating on conveying the sheet bundle P, that is, to prevent a so-called bundle deviation. When the leading end of the sheet bundle P reaches the predetermined position, the upper bundle discharging roller 19 is moved in the direction indicated by the arrow a in FIG. 7 by the operation of a solenoid (not shown) to nip the sheet bundle P together with the lower bundle discharging roller 21.

The bundle discharging speed of the bundle discharging roller pair 19, 21 by the rotation of a bundle discharging motor 56 (FIG. 8), and the bundle conveying speed of the bundle conveying roller pair 14, 16 has a relation of bundle discharging speed≧bundle conveying speed. Therefore, the sheet bundle is conveyed to the predetermined position for performing the stitching operation without being deflected or without deviating. When the sheet bundle is conveyed to the predetermined position, the bundle discharging roller pair 19, 21 and the bundle conveying roller pair 14, 16 stop rotating, and the conveyance of the sheet bundle is stopped.

When the conveyance is stopped, the sheet stitching operation is started by the stapler 32 which is driven by a stapler driving device 57 (FIG. 8). Here, a case in which two places of the sheet bundle P are stapled will be described as an example.

The leading end of the sheet bundle is first stapled as one place. Thereafter, the sheet bundle is again conveyed by the bundle conveying roller pair 14, 16 and bundle discharging roller pair 19, 21 to a stapling position as a second place. After the conveyance of the sheet bundle is stopped in the position, the second place is stapled by the stapler 32. Here, the stapling operation of two places is performed on the sheet bundle P. Additionally, since the stapler 32 has a known constitution and operation, the description thereof is omitted here.

After the stapling operation is completed, the sheet bundle P is again conveyed by the bundle conveying roller pair 14, 16 and the bundle discharging roller pair 19, 21, the trailing end of the sheet bundle is kicked out by the lower bundle discharging roller 21, and the sheet bundle is discharged onto the discharged sheet stacking tray 23.

As described above, the sheet bundle set to be stapled is repeatedly aligned, conveyed, stapled, and discharged, and is successively stacked onto the discharged sheet stacking tray 23.

Figure 9:
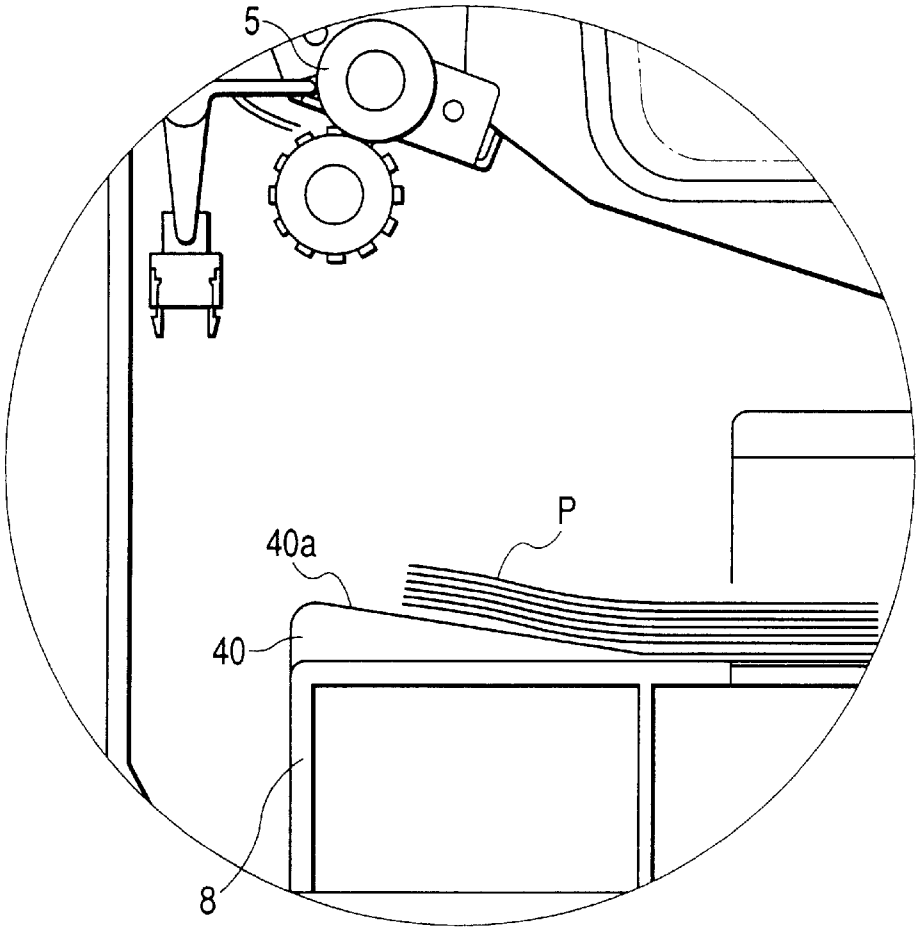
FIG. 9 is a side view of the urging member according to a modification example of the present invention.

FIG. 9 shows another embodiment of the present invention. In FIG. 9, a sheet trailing end lifting rib 40 as an urging member is disposed on the side of the trailing end of the conveying direction of the sheet P stacked on the aligning tray 8 and configured to lift upward the trailing end of the sheet P stacked on the aligning tray 8.

Since the sheet trailing end lifting rib 40 constituted as described above is disposed on the side of the sheet trailing end of the aligning tray 8, the rib 40 has an effect of pressing the sheet P discharged from the discharging roller pair 5 so that the sheet is prevented from moving rearward, in the same manner as the above-described sheet trailing end urging rib 9. Since the trailing end of the sheet P is lifted up as compared with the leading end by an inclined surface 40*a* as an urging surface against the force of the sheet P for deviating rearward, the sheet rigidity and the resistance of the inclination of the sheet trailing end lifting rib 40 prevent the sheet P from moving in the direction opposite to the conveying direction. Thereby, since the sheet P is urged toward the sheet leading end stopper 11, the aligning property of the sheet P is enhanced.

Additionally, the sheet trailing end urging rib 9 and the sheet trailing end lifting rib 40 as the urging members described in the present embodiment may be formed integrally with the aligning tray 8.

Moreover, the sectional shapes of the inclined surfaces 9*a* and 40*a* as the urging surfaces of the urging members described in the present embodiment are substantially linearly inclined, but these inclined surfaces may be curved.

As described above, in the constitution of the sheet treating apparatus, the sheet trailing end discharged onto the aligning tray 8 can be urged toward the sheet leading end stopper 11 for aligning the sheet conveying direction with a simple constitution, and the aligning property in the sheet conveying direction can be enhanced. The mainstream of the conventional sheet treating apparatus comprises inclining the aligning tray toward the discharging roller or toward the opposite side with respect to the horizontal plane, and utilizing the gravity to align the sheets, but by inclining the aligning tray, the sheet treating apparatus is enlarged particularly in the height direction. In the present invention, since the sheet trailing end can be urged toward the sheet leading end with a simple constitution, the aligning tray 8 can be disposed substantially in the horizontal state as described in the present embodiment. This can reduce the size of the sheet treating apparatus in the height direction. Even when the sheet treating apparatus is disposed under the image forming apparatus as in the present embodiment, the operating property of the image forming apparatus is not deteriorated, and there can be provided a sheet treating apparatus which realizes space saving and cost reduction.

What is claimed is:

1. A sheet treating apparatus, comprising:

discharging means for conveying and discharging a sheet on which an image is formed;

sheet stacking means on which the sheet discharged by said discharging means is stacked;

an abutment reference member disposed on a side of a sheet leading end in a direction in which the sheet is discharged from said discharging means onto said sheet stacking means, a leading end of the sheet discharged onto said sheet stacking means to be abutted against said abutment reference member; and an urging member disposed on a side of a sheet trailing end in the direction in which the sheet is discharged from said discharging means onto said sheet stacking means, for urging the sheet discharged from said discharging means toward said abutment reference member, wherein said urging member has an urging surface which is an inclined surface which inclines downward toward an abutment reference member side.

2. A sheet treating apparatus according to claim 1, wherein said urging surface abuts against a trailing end of the sheet discharged from said discharging means.

3. A sheet treating apparatus according to claim 2, wherein a sheet stacking surface of said sheet stacking means is substantially horizontal.

4. A sheet treating apparatus according to claim 1, wherein a trailing end of the sheet discharged onto said sheet stacking means is stacked on said urging surface.

5. A sheet treating apparatus according to claim 2 or claim 4, wherein said urging member is formed integrally with said sheet stacking means.

6. A sheet treating apparatus according to claim 5, wherein said urging member has an urging surface against which the trailing end of the sheet discharged from said discharging means abuts, and said urging surface is an inclined surface which lowers toward said abutment reference member.

7. The sheet treating apparatus according to claim 4, wherein said abutment reference member side of a sheet stacking surface of said sheet stacking means is substantially horizontal.

8. A sheet treating apparatus according to claim 1, wherein said urging member comprises a plurality of ribs spaced apart from each other in a sheet width direction which is perpendicular to said direction in which the sheet is discharged.

9. The sheet treating apparatus according to claim 1, further comprising conveying means for abutting against the sheet discharged onto said sheet stacking means by said discharging means to convey the sheet toward said abutment reference member.

10. The sheet treating apparatus according to claim 9, wherein said conveying means comprises a belt which rotates in a sheet conveying direction.

11. The sheet treating apparatus according to claim 1, further comprising sheet stitching means for stitching sheets stacked onto said sheet stacking means.

12. The sheet treating apparatus according to claim 1, further comprising a leading end pressing member disposed in a vicinity of said abutment reference member for pressing the leading end of the sheet having abutted against said abutment reference member toward said sheet stacking means.

13. The sheet treating apparatus according to claim 1, wherein said urging member is formed integrally with said sheet stacking means.

14. An image forming apparatus, comprising:

a sheet treating apparatus as recited in claim 1; and image forming means for forming an image on a sheet based on image information.

15. The image forming apparatus according to claim 14, wherein said sheet treating apparatus is disposed under said image forming means.

16. A sheet treating apparatus according to claim 1, wherein said urging member has an urging surface on which a trailing end of the sheet discharged on said sheet stacking means is stacked, and said urging surface has an inclined surface which lowers toward an abutment reference member side.

17. A sheet treating apparatus according to claim 1, further comprising width aligning means for aligning the sheet in a sheet width direction perpendicular to a sheet conveying direction after the leading end of the sheet discharged from said discharging means onto said sheet stacking means abuts against said abutment reference member.

18. A sheet treating apparatus comprising:

discharging means for conveying and discharging a sheet on which an image is formed;

sheet stacking means on which the sheet discharged by said discharging means is stacked;

an abutment reference member disposed on a side of a sheet leading end in a direction in which the sheet is discharged from said discharging means onto said sheet stacking means, a leading end of the sheet discharged onto said sheet stacking means to be abutted against said abutment reference member;

an urging member disposed on a side of a sheet trailing end in the direction in which the sheet is discharged from said discharging means onto said sheet stacking means, for urging the sheet discharged from said discharging means towards said abutment reference member; and width aligning means for aligning the sheet in a sheet width direction perpendicular to a sheet conveying direction after the leading end of the sheet discharged from said discharging means onto said sheet stacking means abuts against said abutment reference member, wherein said width aligning means comprises plate members opposed to each other and disposed on both ends in the sheet width direction so that the plate members each abuts against an end of the sheet in the sheet width direction, both or one of said plate members moving in a direction in which the sheet is held, to align the sheet in the sheet width direction, and wherein said plate members each comprises on a surface thereto to abut against the end of the sheet a roller member rotatable in the sheet conveying direction and having a substantially conical shape on an opposite side of each of said plate members, and said roller member presses an upper side of the end of the sheet during a sheet aligning operation by said plate members.

19. The sheet treating apparatus according to claim 18, further comprising sheet stitching means for stitching sheets stacked onto said sheet stacking means and aligned by said width aligning means, wherein an aligning operation of said width aligning means is performed every time the sheet is stacked onto said sheet stacking means, and an aligning operation of said width aligning means performed for a final sheet of a predetermined number of sheets to be stitched by said sheet stitching means is performed more frequently than the aligning operation of said width aligning means performed for a number of sheets less than the predetermined number of sheets.

* * * * *

UNITED STATES PATENT AND TRADEMARK OFFICE

CERTIFICATE OF CORRECTION

PATENT NO. : 6,382,616 B1
DATED : May 7, 2002
INVENTOR(S) : Tsuyoshi Waragai et al.

It is certified that error appears in the above-identified patent and that said Letters Patent is hereby corrected as shown below:

Column 1,
Line 24, “before” should read -- before being --.

Column 2,
Line 1, “case that” should read -- a case where --.

Column 8,
Line 7, “slides” should read -- slide --.
Line 45, “coefficients” should read -- coefficient --.
Line 65, “surface” should read -- surfaces --.

Column 12,
Line 10, “claim 4,” should read -- claim 1, --.

Signed and Sealed this

Thirteenth Day of August, 2002

*Attest:*

*Attesting Officer*

JAMES E. ROGAN
*Director of the United States Patent and Trademark Office*